United States Patent [19]

Beach

[11] Patent Number: 4,816,620

[45] Date of Patent: Mar. 28, 1989

[54] SMALL DIAMETER TOW CABLE

[75] Inventor: Glenn R. Beach, Columbia, Md.

[73] Assignee: Westinghouse Electric Corp., Pittsburgh, Pa.

[21] Appl. No.: 104,699

[22] Filed: Oct. 5, 1987

[51] Int. Cl.[4] ..... H01B 7/04

[52] U.S. Cl. ..... 174/115; 174/113 C; 174/131 A

[58] Field of Search ..... 174/113 C, 115, 131 A, 174/131 B; 367/177; 244/1 JD, 3; 114/253

[56] References Cited

U.S. PATENT DOCUMENTS

| | | | |
|---|---|---|---|
| 1,123,267 | 1/1915 | Fisher | 174/115 |
| 2,268,223 | 12/1944 | Peterson | 174/115 |
| 4,010,619 | 3/1977 | Hightower et al. | 174/115 X |
| 4,084,065 | 4/1978 | Swenson | 174/131 A X |
| 4,117,447 | 9/1978 | Gould et al. | 114/253 X |
| 4,634,805 | 1/1987 | Orban | 174/131 A X |

FOREIGN PATENT DOCUMENTS

| | | | |
|---|---|---|---|
| 2724310 | 12/1978 | Fed. Rep. of Germany | 174/115 |
| 481594 | 6/1953 | Italy | 174/115 |
| 469495 | 7/1937 | United Kingdom | 174/115 |

*Primary Examiner*—Morris H. Nimmo

*Attorney, Agent, or Firm*—D. Schron

[57] ABSTRACT

An electromechanical tow cable which includes a central strength member comprised of a plurality of yarns of electrically conducting aramid fibers. The electrically conducting central member is surrounded by a dielectric medium on the surface of which is located two or more groups of electrically conducting wires circumferentially separated by electrically insulating sections. An outer electrically insulating jacket forms a protection for the cable. The central conducting strength member may be utilized for the application of a relatively high voltage which utilizes one of the conducting wire groups as a ground return. Another one of the conducting wire groups may be utilized for a relatively lower voltage which may utilize the same conductor group as the high voltage for a ground return.

11 Claims, 4 Drawing Sheets

SMALL DIAMETER TOW CABLE

BACKGROUND OF THE INVENTION

1. Field of the Invention

The invention in general relates to tow cables, and more particularly to a tow cable of the electromechanical variety.

2. Description of the Prior Art

Tow cables are utilized in a variety of operational situations, one of which is in the towing of target drones by a towing aircraft In the field of electronic warfare, a typical target drone may house a transmitter as well as other active and/or passive electronic devices all or some of which require a power supply and control circuit.

Since the drones are expendable, an economic advantage may be realized if the power supply and control circuits are located in the towing aircraft rather than in the expendable drone. For this purpose, a tow cable is utilized which not only serves as a mechanical strength member but in addition includes integral power and signal conductors.

In many instances, the towing aircraft has a very limited volumetric space allotted for the packaging of the plurality of expendable drones together with power supplies, control circuits and spools of tow cable. In order to achieve an overall volumetric reduction, the tow cable must be of relatively small diameter so that for the same length of tow cable the cable spool may be of reduced size. Under such circumstances, it is imperative that the smaller diameter tow cable be strong enough to perform its towing function and at the same time conduct all necessary electrical energy from the towing craft to the drone.

SUMMARY OF THE INVENTION

The present invention provides for a very small diameter tow cable to meet the above-stated requirements. The tow cable in accordance with the present invention includes a central strength member comprised of a plurality of synthetic fibers having an electrically conducting coating thereon for application of a first and relatively high voltage. A dielectric medium surrounds the central strength member and a first group of electrically conducting wires are disposed on the surface of the dielectric medium for application of a second and relatively lower voltage. One or more other groups of electrically conducting wires are disposed on the surface of the dielectric medium, circumferentially spaced from one another and from the first group. One of these other groups of electrically conducting wires forms an electrical ground return for the relatively high voltage, and in one embodiment for the relatively lower voltage as well. An electrically insulating outer jacket contacts the electrically conducting wires and forms a protective coating for the cable.

DESCRIPTION OF THE PREFERRED EMBODIMENTS

Figure 1:
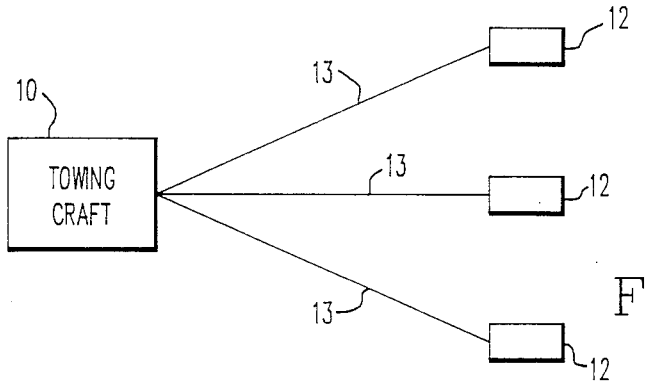
FIG. 1 depicts an operational situation in which the tow cable of the present invention may be utilized.

Referring now to FIG. 1, there is depicted a situation wherein a towing craft 10 is trailing behind it three towed bodies or drones 12 connected to the towing craft by respective tow cables 13.

Figure 2:
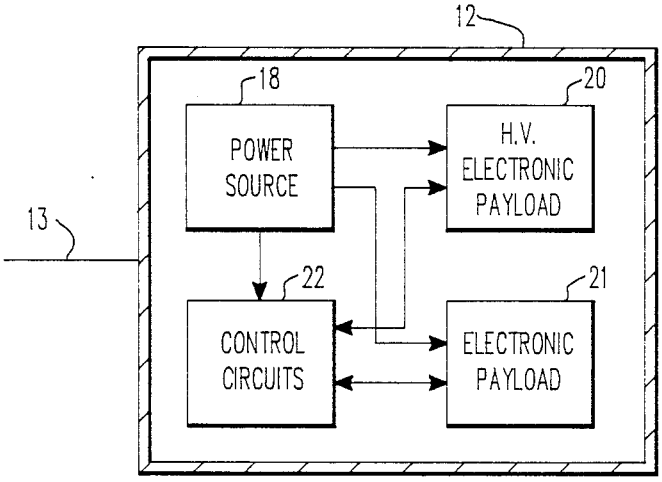
FIG. 2 PRIOR ART
FIG. 2 is a block diagram illustrating drone carried equipment required when a conventional mechanical tow cable is utilized.

The towing craft may be an aircraft, surface or subsurface vessel and by way of example the present invention will be described with respect to an aircraft situation wherein the towed bodies are electronic warfare drones which may carry both high voltage and low voltage devices such as illustrated in FIG. 2.

In simplified form, a typical drone 12 includes a power source 18 for supplying electrical energy to a plurality of electronic payloads, two of which 20 and 21 are illustrated, with the electronic payload 20 being operable at high voltages. A relatively lower voltage is also provided to control circuits 22 for controlling the operation of the various payloads.

Figure 3:
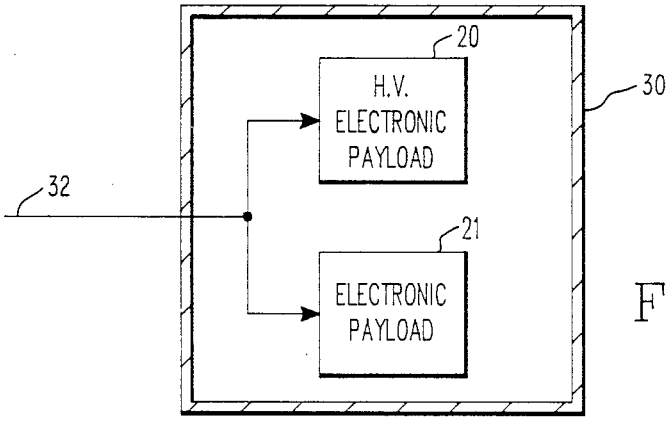
FIG. 3 illustrates drone carried equipment when the tow cable of the present invention is utilized.

After a mission, the expendable drones are released from the towing aircraft such as by severing of the tow cable 13. The per-unit cost of the drones can be reduced significantly if the power source and control circuits can be placed in the towing aircraft so that they may be reused after each mission. With this arrangement, the tow cable must be of the electromechanical variety and due to the limited volumetric space allotted to the drones, power supplies, control circuits and tow cable, the tow cable must be of extremely small diameter yet must be of sufficiently high strength to accomplish the towing task while transferring electrical energy from the power supply on the aircraft to the payed-out drone, FIG. 3 illustrates the concept with a drone 30 towed by an electromechanical tow cable 32 and wherein the power source and control circuits have been removed to the towing aircraft.

Figure 4:
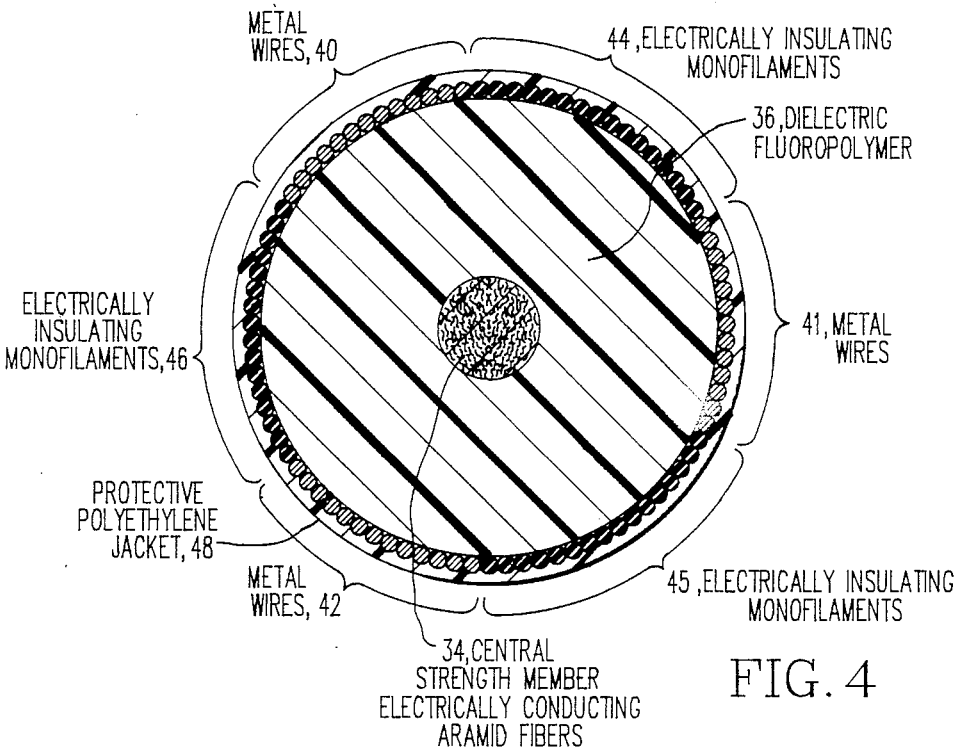
FIG. 4 is a cross-sectional view of a tow cable in accordance with one embodiment of the present invention.

FIG. 4 illustrates a cross-section of an electromechanical tow cable in accordance with one embodiment of the invention. The cable includes a central strength member 34 comprised of a plurality of synthetic fibers having an electrically conducting coating thereon. In one embodiment, the fibers may be an aromatic amide (aramid) organic fiber one example of which is known as Kevlar produced by the DuPont Company of Wilmington, Del. A suitable electrically conducting coated aramid fiber is available from Material Concepts, Inc. of Columbus, Ohio. By way of example for electrical conductivity, the conducting coating may be of copper, boronated nickel or phosphorus nickel, to name a few. The central strength member 34 may be comprised of a plurality of yarns of conductive aramid, for example three, helixed at approximately 6° to 8° to form a round bundle.

The bundled central conducting strength member is contacted and surrounded by a tubed extrusion of a high dielectric medium 36 such as a fluoropolymer. Disposed on the surface of the dielectric medium is a first group of conducting wires 40 as well as second and third groups 41 and 42 circumferentially spaced from one another and separated by respective electrically insulating monofilament groups 44 to 46.

The electrically conducting wires of the groups are preferably helixed in an opposite direction to the bundles comprising the central strength member 34 and are placed at a lay angle of approximately 12° to 20° . In order to survive manufacturing processes, the conducting wires are preferably of high strength such as achievable with PD-135 alloy copper.

Figure 5:
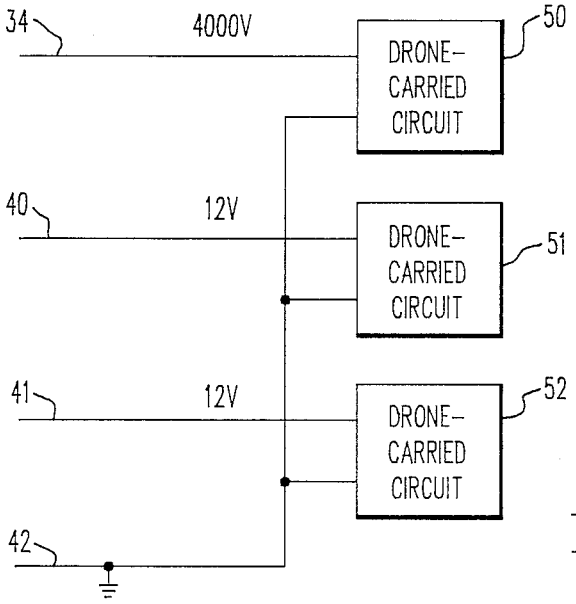
FIG. 5 is a block diagram illustrating typical electrical connections for the cable of FIG. 4.

The conductor wire and monofilament groups are provided with an electrically insulating protective jacket 48 which may be a tubed extrusion of a suitable thermoplastic polymer such as polyethylene. With additional reference to FIG. 5, numerals 50 to 52 represent drone carried circuits requiring operating voltage from a power supply aboard the towing craft (not illustrated). By way of example device 50 may require a relatively high voltage of 4000 volts while the other two devices 51 and 52 require relatively lower voltages of 12 volts (although the ampere requirements may be different). With the improved cable construction described herein, the relatively high voltage is applied to the central conducting strength member 34 while the relatively lower voltages are applied to conductor groups 40 and 41. Conductor group 42 forms the electrical ground return for all three applied voltages.

In a typical cable, three yarns of 1500 denier Kevlar yarn would result in a central conducting strength member having a diameter of 0.0336 inch (0.853 millimeter). With a dielectric medium 36 exhibiting an average voltage stress of 110 volts per mil, the diameter of the dielectric medium would be in the order of 0.1056 inch (2.682 millimeters) for the voltage requirements given. Each wire group may be comprised of a plurality of strands, for example 10 to 13, of AWG40 wire each having a diameter of approximately 0.00315 inch (0.080 millimeter). With an outer protective jacket of for example 0.008 inch (0.203 millimeter) the overall diameter of the tow cable would be 0.1279 inch (3.248 millimeters) and have a breaking strength of from 100 to 150 pounds.

Figure 6:
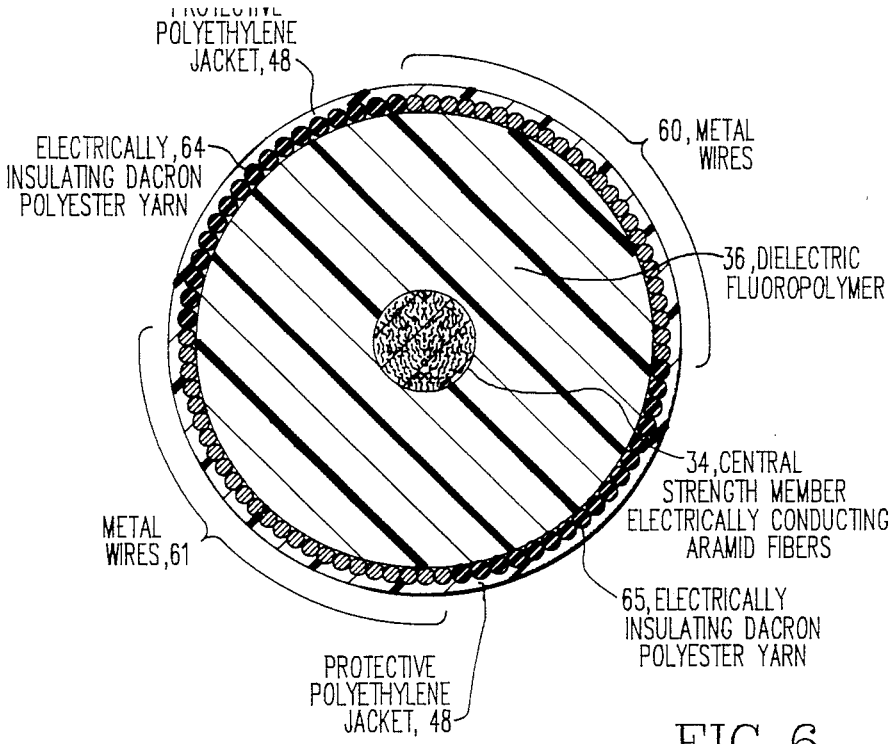
FIG. 6 is a cross-sectional view of a tow cable in accordance with another embodiment of the present invention.

FIG. 6 illustrates a cross-sectional view of another embodiment of the present invention which includes the same central conducting strength member 34 and dielectric medium 36 but which includes however only first and second groups of conducting wires 60 and 61 on the surface of the dielectric medium. The groups of conducting wires are diametrically opposed and are separated by electrically insulating yarn sections 64 and 65 such as a dacronpolyester which is placed on the dielectric medium at the same helix angle as the conducting wires. The arrangement of FIG. 6 may utilize the same electrically insulating protective jacket 48 as previously described.

Figure 7:
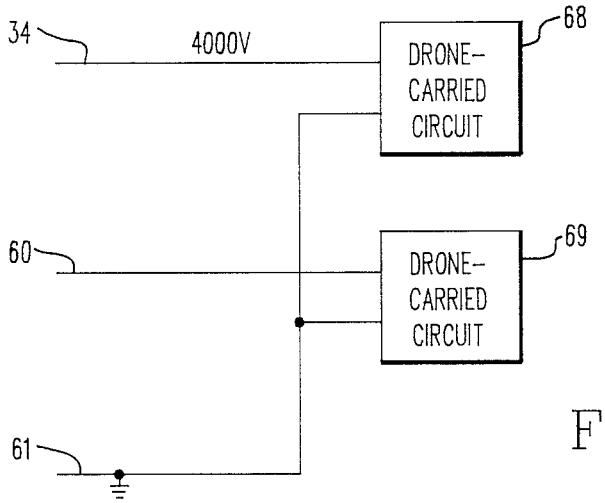
FIG. 7 is a block diagram illustrating typical electrical connections for the cable of FIG. 6.

With the embodiment of FIG. 6, and as further illustrated in FIG. 7, only two voltages are utilized for supplying circuit devices 68 and 69. The central conducting strength member 34 may be for application of the relatively high voltage, whereas first conductor group 60 for example may be for a low voltage DC application such as previously described, or a higher voltage AC application such as a conventional 110 volts supply. For both voltages, conductor group 61 forms the return ground.

Figure 8:
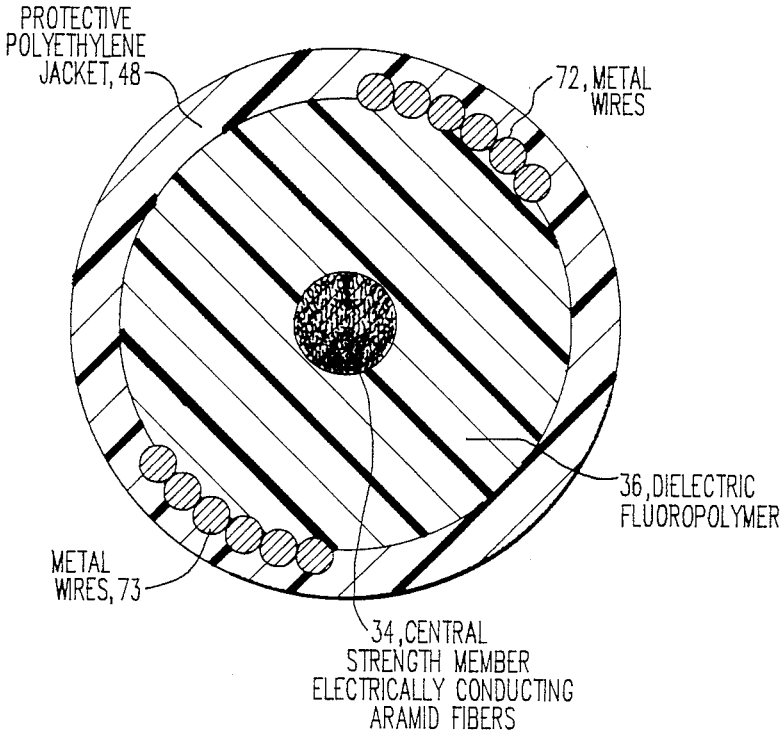
FIG. 8 is a cross-sectional view of a tow cable in accordance with another embodiment of the present invention.

FIG. 8 illustrates a modification of the embodiment described in FIG. 6. In the embodiment of FIG. 8, first and second groups of conducting wires 72 and 73 are provided and are comprised of a fewer number of strands of larger diameter, for example 0.0063 inch (0.160 millimeter) PD-135 alloy copper wires. The wires of each group may be heat set into the surface of the dielectric medium 36 and the protective jacket 48 forms the circumferential electrically insulating sections previously provided by the monofilament groups (FIG. 4) or the yarn (FIG. 6).

I claim:

1. An improved tow cable comprising:

(A) a central strength member comprised of a plurality of synthetic fibers having an electrically conducting coating thereon, for application of a first and relatively high voltage;

(B) a dielectric medium directly surrounding said central member;

(C) a first group of electrically conducting wires disposed on the surface of said dielectric medium for application of a second and relatively lower voltage;

(D) at least a second group of electrically conducting wires disposed on the surface of said dielectric medium and being circumferentially spaced from said first group;

(E) said second group of electrically conducting wires forming an electrical ground return for at least said first voltage; and (F) an electrically insulating outer jacket contacting said electrically conducting wires.

2. An improved tow cable according to claim 1 wherein:

said second group of electrically conducting wires form the electrical ground return for said second voltage as well as said first voltage.

3. An improved tow cable according to claim 1 which includes:

electrically insulating sections circumferentially disposed between said groups of electrically conducting wires.

4. An improved tow cable according to claim 3 wherein:

said electrically insulating sections are comprised of a layer of individual monofilaments disposed in side by side fashion.

5. An improved tow cable according to claim 3 wherein:

said electrically insulating sections are comprised of sections of electrically insulating yarn.

6. An improved tow cable according to claim 3 wherein:

said groups of electrically conducting wires are imbedded in the surface of said dielectric medium and said outer jacket forms said electrically insulating sections.

7. An improved tow cable according to claim 1 wherein:

said fibers are aramid fibers.

8. An improved tow cable according to claim 7 wherein:

said electrically conducting coating is chosen from the group consisting of (i) copper (ii) boronated nickel (iii) phosphorous.

9. An improved tow cable according to claim 1 wherein:

said central strength member is comprised of a plurality of yarns of said synthetic fibers.

10. An improved tow cable according to claim 9 wherein:

said yarns are bundled together at a helical lay angle of approximately 8°.

11. An improved tow cable according to claim 9 wherein:

said groups of electrically conducting wire are disposed on the surface of said dielectric medium of a helical lay angle of approximately 12° to 20°, and opposite the lay of said yarns.

* * * * *